US010054112B2

(12) United States Patent
Klausmann et al.

(10) Patent No.: US 10,054,112 B2
(45) **Date of Patent: *Aug. 21, 2018**

(54) ADJUSTMENT DEVICE FOR A HYDROSTATIC PISTON MACHINE, AND HYDROSTATIC AXIAL PISTON MACHINE

(71) Applicant: Robert Bosch GmbH, Stuttgart (DE)

(72) Inventors: Nadine Klausmann, Oberndorf (DE); Benjamin Weihing, Haiterbach (DE); Andreas Apperger, Eutingen (DE); Carola Diebold, Empfingen (DE); Philipp Schramm, Rottenburg (DE); Ruslan Rudik, Horb (DE)

(73) Assignee: Robert Bosch GmbH, Stuttgart (DE)

( * ) Notice: Subject to any disclaimer, the term of this patent is extended or adjusted under 35 U.S.C. 154(b) by 506 days.

This patent is subject to a terminal disclaimer.

(21) Appl. No.: 14/718,752

(22) Filed: May 21, 2015

(65) Prior Publication Data

US 2015/0337814 A1 Nov. 26, 2015

(30) Foreign Application Priority Data

May 22, 2014 (DE) ..... 10 2014 209 748
Apr. 22, 2015 (DE) ..... 10 2015 207 260

(51) Int. Cl.
*F04B 1/12* (2006.01)
*F04B 1/32* (2006.01)
*F04B 1/20* (2006.01)

(52) U.S. Cl.
CPC ..... *F04B 1/324* (2013.01); *F04B 1/2042* (2013.01)

(58) Field of Classification Search
CPC .... F04B 9/09; F04B 9/10; F04B 1/324; F04B 1/2042; F04B 1/205
USPC ..... 251/337
See application file for complete search history.

(56) References Cited

U.S. PATENT DOCUMENTS 3,489,094 A * 1/1970 Vanzee ..... F04B 49/08 250/214 R
3,834,281 A * 9/1974 Heyl ..... F04B 1/122 417/222.1
3,985,469 A * 10/1976 Ohta ..... F04B 1/324 417/222.1

(Continued)

FOREIGN PATENT DOCUMENTS

DE 40 20 325 A1 1/1992
DE 100 01 826 C1 9/2001

*Primary Examiner* — Charles Freay
(74) *Attorney, Agent, or Firm* — Maginot, Moore & Beck LLP

(57) ABSTRACT

An adjustment device for regulating torque of a hydrostatic piston machine includes a piston delimiting a chamber, a regulation valve, feedback and regulation springs, and a member. The valve has a displaceable slide to enable pressure medium to flow into or out of the chamber, a measurement surface acted on by pressure from the piston machine, and a bore open to the chamber, a side facing the chamber acted on by a chamber pressure in a first direction. The feedback spring exerts force on the slide in the first direction, depending on a position of the piston. The regulation spring exerts force on the slide in a second direction opposite the first direction. The member has a surface as large as the side of the bore such that the chamber pressure exerts force on the slide in the second direction.

20 Claims, 8 Drawing Sheets

(56) References Cited

U.S. PATENT DOCUMENTS

| | | | | | |
|---|---|---|---|---|---|
| 4,379,389 | A * | 4/1983 | Liesener | F04B 49/08 | 60/428 |
| 4,779,837 | A * | 10/1988 | Mito | B27D 3/00 | 251/25 |
| 7,334,513 | B2 * | 2/2008 | Belser | F04B 1/324 | 92/12.1 |

* cited by examiner

ADJUSTMENT DEVICE FOR A HYDROSTATIC PISTON MACHINE, AND HYDROSTATIC AXIAL PISTON MACHINE

This application claims priority under 35 U.S.C. § 119 to patent application no. DE 10 2014 209 748.7, filed on May 22, 2014 in Germany, and to patent application no. DE 10 2015 207 260.6, filed on Apr. 22, 2015, the disclosures of which are incorporated herein by reference in their entirety.

The disclosure relates to an adjustment device which is provided for a hydrostatic machine, in particular for a hydrostatic axial piston machine, and to a hydrostatic axial piston machine, in particular an axial piston pump, which is equipped with an adjustment device of said type.

BACKGROUND

For the regulation of hydrostatic piston machines, adjustment devices having an adjustment piston and having a regulation valve are known, by means of which it is achieved that a torque received or output by the piston machine does not exceed a particular value or value range. This type of regulation is referred to as torque regulation, or also as power regulation, wherein the latter designation disregards the fact that the power of a machine is in fact co-determined by the rotational speed thereof. The regulation valve is referred to as torque regulator or as power regulator. Power regulation arrangements exist in the case of which the product of the pressure at the pressure port of the piston machine and the swept volume is kept constant. Here, the swept volume is the pressure medium quantity that flows through the machine per rotation of the drive shaft. In the case of other types of power regulation, a hyperbolic characteristic curve between swept volume and pressure, on which curve the torque is constant, is approximated by straight lines. In the case of such torque regulation, the torque is kept only approximately constant, wherein the adjustment device can be made simpler and more compact than an adjustment device with regulation to a constant torque.

DE 40 20 325 C2 has disclosed an adjustment device for approximate regulation to a constant torque for an adjustable hydrostatic pump, wherein the valve slide of a regulation valve, also referred to as power regulator, is displaceable in a bushing that can be driven by the adjustment piston, and said valve slide is acted on in a first displacement direction by the pump pressure and in the opposite displacement direction by a spring pack composed of two springs which are braced between the valve slide and plate springs which are adjustable but which otherwise have an inherent fixed position. In addition to the regulation valve provided for the regulation of the torque, the known adjustment device also includes a pressure regulation valve, also referred to as pressure regulator, and a delivery flow regulation valve, also referred to as delivery flow regulator. By means of each of said regulators, the inflow and outflow of control oil into the adjustment chamber and out of the adjustment chamber can be controlled at the adjustment piston. The special feature of the power regulation in this case is that the travel of the adjustment piston is fed back directly, as a travel, to the bushing of the power regulator.

U.S. Pat. No. 4,379,389 has disclosed an axial piston pump of swashplate type of construction, having a drive shaft, having a cylinder drum in which the displacement pistons are situated, having a swashplate, and having an adjustment device for power regulation. Here, the adjustment piston and the valve slide of the power regulator are arranged in alignment one behind the other. In the case of the axial piston pump known from U.S. Pat. No. 4,379,389, when the swept volume is at a maximum, the adjustment piston is deployed to the maximum extent, and the adjustment chamber at the adjustment piston has its largest volume. The valve slide is acted on by the pump pressure in a first displacement direction. In the event of an adjustment in said direction from the neutral position, control oil is discharged from the adjustment chamber and the adjustment piston retracts. Between the adjustment piston and the valve slide there are braced two feedback springs which are in the form of helical compression springs and of which a first feedback spring exerts a force on the valve slide over the entire travel of the adjustment piston, and the second feedback spring exerts a force on the valve slide only after a particular partial stroke of the adjustment piston proceeding from that position of the adjustment piston which corresponds to a maximum swept volume. In this way, a hyperbolic characteristic curve on which the torque is constant is approximated by two straight lines. In the case of an adjustment device according to U.S. Pat. No. 4,379,389, the travel of the adjustment piston is fed back, as a force, to the valve slide.

A hydrostatic axial piston machine having an adjustment device is also known from DE 100 01 826 C1. Said swashplate-type axial piston machine, designed as an axial piston pump, has a drive unit with a multiplicity of displacement pistons which are guided in cylinder bores of a cylinder drum and which, together with said cylinder bores, delimit in each case one working chamber. The displacement pistons are supported via slide shoes on a swashplate, the angle of inclination of which is variable for the purposes of varying the swept volume. Owing to the pivoting capability, an adjustable swashplate is also referred to as pivot cradle. The adjustment is performed by way of an adjustment device which has an adjustment piston which engages indirectly or directly on the pivot cradle and pivots the latter out of a basic position into which the pivot cradle is preloaded by way of an opposing piston or a spring. In the basic position, the pivot cradle may for example be set to its maximum pivot angle, in which the swept volume is at a maximum. By contrast to the axial piston pump according to U.S. Pat. No. 4,379,389, the adjustment piston is fully retracted, and the adjustment chamber has its smallest volume, when the swept volume is at a maximum. Deployment of the adjustment piston causes the pivot cradle to be pivoted back toward smaller pivot angles and smaller swept volumes.

The adjustment piston delimits an adjustment chamber which is connectable by way of a regulation valve (so-called power regulator) to a line which conducts the pump pressure or to a tank. The regulation valve has a valve slide which has the same central axis as the adjustment piston and which is preloaded by way of two feedback springs into a basic position in which the adjustment chamber is connected to the tank. To now achieve that the adjustment piston is fully retracted in the basic position, which corresponds to maximum swept volume, the feedback springs are supported on a spring rod which extends through the valve slide and is connected to the adjustment piston. The valve slide is a stepped piston with a differential surface which is acted on with the pump pressure and is arranged such that the pump pressure generates, on the valve slide, a force which is directed counter to the force of the feedback springs.

In the known solution, the two feedback springs are helical springs which are arranged coaxially with respect to one another and of which one, proceeding from a fully retracted adjustment piston and minimum adjustment chamber, acts only after a particular partial stroke and thus proceeding from a particular position of the adjustment piston on the valve slide. This yields a p-Q characteristic curve (pressure-swept volume characteristic curve) composed of two straight lines, wherein the gradient of one straight line is defined by the spring constant of the spring that is initially in engagement, and the gradient of the further straight line is defined by the sum of the spring constants of the springs which, after the partial stroke, are jointly in engagement. By means of these two straight lines that are inclined relative to one another, the hyperbolic p-Q characteristic curve, on which the torque is constant, is obtained in approximated fashion. The characteristic curve made up of two straight lines has a bend in the delivery volume, which bend corresponds to the position of the adjustment piston at which the second feedback spring begins to act.

A disadvantage of the known solution is that, owing to the spring rod which extends through the regulating piston, the adjustment device is of highly complex construction and furthermore has a considerable structural length.

SUMMARY

By contrast, the disclosure is based on the object of providing an adjustment device and an axial piston machine equipped with an adjustment device of said type, with which power/torque regulation is made possible with reduced outlay in terms of apparatus.

Said object is achieved, with regard to the adjustment device, by means of the features disclosed herein.

An adjustment device according to the disclosure for regulating the torque of a hydrostatic piston machine with adjustable swept volume has an adjustment piston which delimits an adjustment chamber, a regulation valve which customarily has a first port, a second port and a third port, the latter being fluidically connected to the adjustment chamber, and which has a valve slide which, in a regulation position, in the case of positive overlap, separates the third port from the first port and from the second port or, in the case of negative overlap, connects the third port via small throughflow cross sections to the first port and to the second port and, outside the regulation position, fluidically connects the third port to the first port or to the second port, such that pressure medium flows into the adjustment chamber or out of the adjustment chamber. The valve slide has a measurement surface at which said valve slide can be acted on by the operating pressure of the piston machine in a first displacement direction. An adjustment device according to the disclosure furthermore has at least one feedback spring which exerts on the valve slide a feedback force which is dependent on the position of the adjustment piston. The feedback force exerted by the feedback spring is oriented in the first displacement direction, that is to say in the same displacement direction as the force generated by the operating pressure at the measurement surface of the valve slide. If only one feedback spring is provided, the hyperbolic torque characteristic curve is approximated by one straight line. With multiple feedback springs, it is possible to obtain a torque characteristic curve which is approximated to the hyperbolic torque characteristic curve by way of multiple straight lines. A regulation spring is provided which exerts on the valve slide a force in a second displacement direction opposite to the first displacement direction. The valve bore with the valve slide is open toward the adjustment chamber, such that the valve slide, at its face side facing toward the adjustment chamber, is acted on by the adjustment pressure in the first displacement direction. Furthermore, a compensation surface is provided which is as large as that surface on the valve slide at which the adjustment pressure generates a force in the first displacement direction. At the compensation surface, the adjustment pressure generates a force in the second displacement direction which acts on the valve slide.

In the case of an adjustment device according to the disclosure, it is the case, as in the known adjustment devices, that the valve slide assumes its regulation position when the forces acting thereon are in equilibrium in the regulation position. Owing to the compensation surface, the adjustment pressure prevailing in the adjustment chamber does not exert a resultant force on the valve slide, such that, in the regulation position, the sum of the spring force of the at least one feedback spring and of the pressure force exerted by the operating pressure is equal to the spring force of the regulation spring plus any auxiliary force that acts with the regulation spring. A change in operating pressure leads to a displacement of the valve slide out of the regulation position. Pressure medium then flows to the adjustment chamber or out of the adjustment chamber, such that the adjustment piston is moved and the spring force exerted on the valve slide by the at least one feedback spring changes. The valve slide returns into its regulation position and stops the pressure medium flow as soon as the adjustment piston has reached a position in which the change in operating pressure has been compensated by an opposing change in the spring force of the feedback spring, and the sum of the spring force of the feedback spring and of the pressure force is again equal to the spring force of the regulation spring plus any auxiliary force that acts with the regulation spring. Here, it is also pointed out that, normally, the operating pressure is the variable, and the swept volume is adjusted correspondingly.

The main advantage of the solution according to the disclosure consists in that the piston rod can be omitted, such that the adjustment device can be realized with lower outlay in terms of apparatus and with a shorter structural length. At least one feedback spring is provided. It is also possible for two feedback springs or even more than two feedback springs to be provided, wherein, in the latter case, a pressure-swept volume characteristic curve with more than one bend is possible. In the case of an adjustment device according to the disclosure for regulating the torque of a hydrostatic piston machine, the valve bore is open toward the adjustment chamber, such that the single feedback spring that is provided or the multiple feedback springs that are provided can readily be arranged in the region of the adjustment piston and act on the valve slide in a direction away from the adjustment piston. Nevertheless, the adjustment pressure in the adjustment chamber does not exert a resultant force on the valve slide, as the valve slide is force-balanced with regard to the adjustment pressure owing to the action of the adjustment pressure on a compensation surface. This is of particular advantage with regard to the torque regulation. This is because, even if the adjustment pressure is generally significantly lower than the operating pressure, a resultant force exerted by the adjustment pressure on the valve slide would have an adverse effect on the accuracy of the power regulation, especially since the adjustment pressure is dependent on the operating pressure, on the force, which varies with the position of the adjustment piston, of a restoring spring for the swashplate, and on other parameters.

The object is also achieved by means of a hydrostatic axial piston machine which has an adjustment device according to the disclosure as described above.

Advantageous refinements of an adjustment device according to the disclosure emerge from the description, drawings, and the claims.

In the case of an adjustment device according to the disclosure, the adjustment piston customarily has the smallest spacing to the valve slide at maximum swept volume of the piston machine, and has the greatest spacing to the valve slide at minimum swept volume of the piston machine.

It is advantageous if the compensation surface is an annular surface on a component which has a collar with the annular surface and which has a central projection with a smaller diameter than the collar, wherein the collar, by way of the annular surface, delimits a pressure chamber which is fluidically connected to the adjustment chamber, and wherein the central projection, by way of a diameter which defines the inner diameter of the annular surface, protrudes in sealing fashion into a central recess which is open toward the pressure chamber. The particular advantage of this refinement consists in that, owing to the central projection outside the pressure chamber in which the adjustment pressure prevails, means are provided which can be very easily utilized for realizing adjustment devices with different external influencing of the regulation valve.

For example, a volume in front of the free end of the central projection may be charged with a pressure which is at least approximately tank pressure. Here, the volume is preferably fluidically connected via a bore arrangement in the component to a tank port of the regulation valve. In this case, it is desired for the regulation not to be influenced by an externally applied control pressure. If it is also desired for there to be no other adjustment of the torque characteristic curve, the volume in front of the free end of the central projection may be closed off to the outside.

If the torque characteristic curve is to be adjustable during operation, it may be provided that the projection can be acted on with a force such that a force exceeding the force of the regulation spring can be exerted on the valve slide in the second displacement direction. It is accordingly possible for the volume in front of the free end of the central projection to be charged with a hydraulic or pneumatic control pressure, wherein, then, there is self-evidently no internal connection from the volume to the tank.

If the regulation spring is situated, so as to surround the central projection of the component and be supported against the annular surface, in the pressure chamber, the same installation space is utilized, in the axial direction of the adjustment device, for the component with the annular surface and for the regulation spring.

It is preferably the case that, in an elongation of the valve bore, there is fastened to the valve housing an auxiliary housing part which is equipped with a cavity, said cavity having a cavity section for forming the central recess which is open toward the pressure chamber and into which the central projection of the component protrudes in sealing fashion.

It is preferably the case that the cavity of the auxiliary housing part has a further cavity section for receiving the collar with the annular surface and for forming the pressure chamber. The guide of the collar with the annular surface and the guide of the central projection in the auxiliary housing part are thus realized, such that the two guides can be produced so as to be well aligned with one another.

If it is not necessary for the component with the compensation surface to be capable of being acted on with a fluid pressure for the purposes of generating an auxiliary force, it is thus possible for the compensation surface to be a circular surface on the component which is then of plunger piston-like form, wherein said component, at its outer circumference, is guided in sealed fashion with respect to the valve ports in the valve housing and, on one side of the guide length, at a face side facing away from the adjustment piston, delimits a pressure chamber which is fluidically connected to the adjustment chamber. On the other side of the guide length for the plunger piston-like component, the valve bore is fluidically connected to a tank port of the regulation valve.

It is then advantageously the case that an opposing spring is, independently of the plunger piston-like component, braced against a collar of the valve slide and against an abutment which is positionally fixed with respect to the valve housing.

There may be inserted into the valve housing a bushing, the inner diameter of which defines a surface which is of the same size as that surface on the valve slide at which the valve slide is acted on by the adjustment pressure in the first displacement direction. The plunger piston-like component is guided in sealed fashion in the bushing. The opposing spring is advantageously braced between the collar of the valve slide and the bushing.

The bushing can be fixed in the housing by way of a spring element, in particular by way of a plate spring which takes up only a small installation space, wherein the spring element forces the bushing against a step in the valve housing and is itself braced between the bushing and a component, which is screwed into the valve housing or screwed onto the valve housing, or a structural assembly, which is screwed in or screwed on.

It is basically conceivable for the component with the compensation surface to be the valve slide. It is however preferable, for easier manufacture, for the component and the valve slide to be structurally separate, wherein the component is formed in the manner of a compensation piston and is guided in longitudinally movable fashion independently of the valve slide. Alignment errors between the guide of the valve slide and the guide of the compensation piston then do not have an effect on the free movement of the valve slide.

It may be possible for the component with the compensation surface to be acted on with a force by way of a mechanical component. In particular, said force can be exerted by an electromagnet, for example by a switching magnet, but in particular by a proportional electromagnet, the force of which is, over a broad range, proportional to an electrical current flowing through it. In the event that the component with the compensation surface is a component with an annular surface and with a central projection, the volume in front of the free end of the central projection is charged with a pressure, in particular with the pressure in the interior of the housing of the piston machine, which is at least approximately tank pressure. Thus, the electromagnet, too, is acted on only with pressures lower than 10 bar, and therefore need not be resistant to high pressures. If the component with the compensation surface is of plunger piston-like form, said component can be acted on by an electromagnet in a simple manner if the electromagnet is resistant to high pressure. The adjustment pressure then prevails in the electromagnet during operation.

A highly compact design can be realized by virtue of the fluid connections being controlled by means of an annular groove in the valve slide and by means of a fluid path, running within the valve slide, from the annular groove into the adjustment chamber.

BRIEF DESCRIPTION OF THE DRAWINGS

Exemplary embodiments of an adjustment device according to the disclosure are illustrated in the drawings. The disclosure will now be discussed in more detail on the basis of the figures of said drawings.

In the drawings.

DETAILED DESCRIPTION

Figure 1:
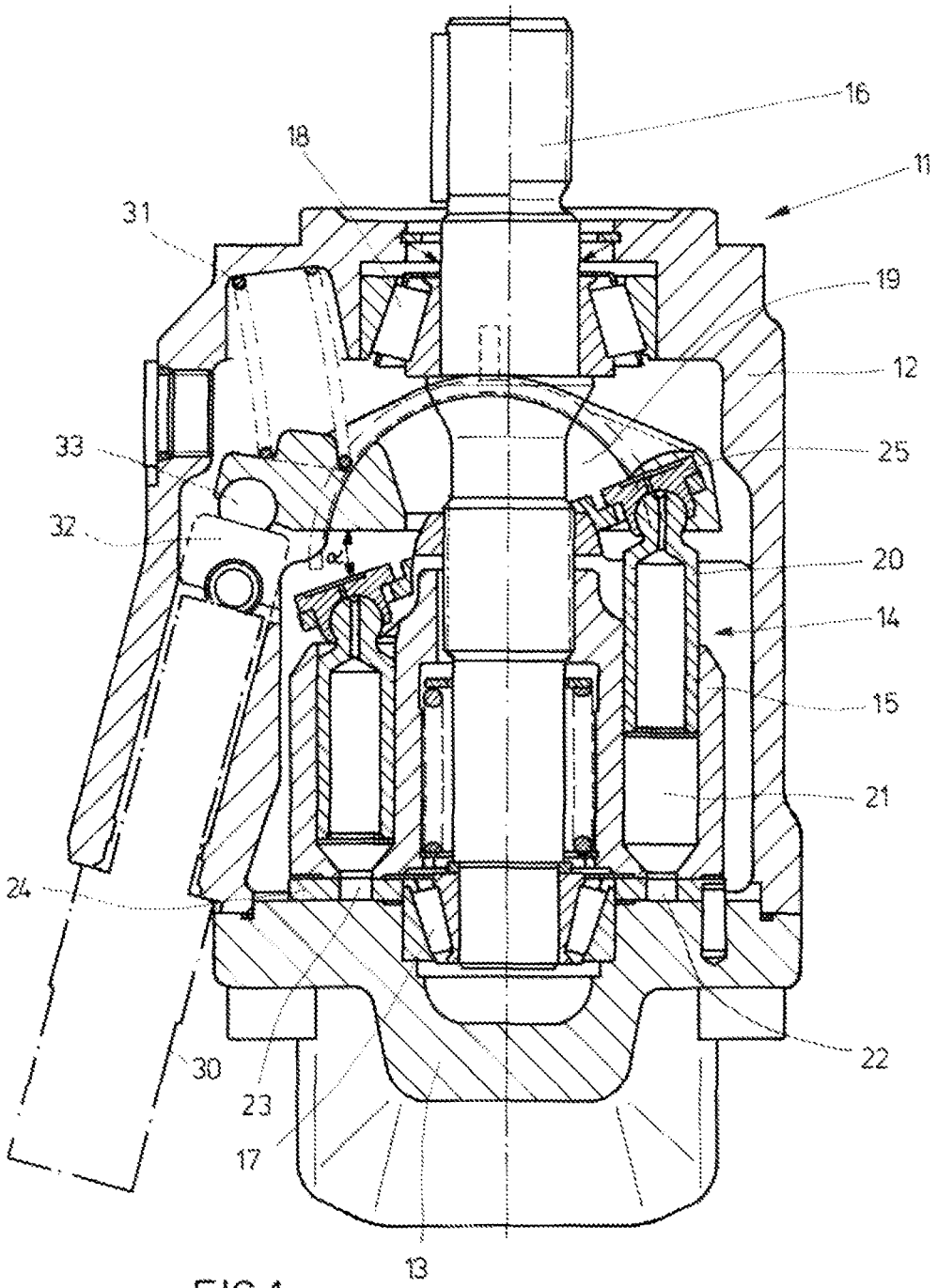
FIG. 1 shows a longitudinal section through an axial piston pump of swashplate type of construction with the external contour of the two exemplary embodiments of an adjustment device according to the disclosure.

The hydrostatic axial piston machine shown in FIG. 1 is designed as an axial piston pump. It has a pump housing 11 which is composed of a pot-shaped housing main part 12 and of a port plate 13 and in which a drive unit 14 is accommodated. Said drive unit includes a cylinder drum 15, a drive shaft 16, which is mounted in the pump housing by way of two tapered-roller bearings 17 and 18 and to which the cylinder drum 15 is rotationally conjointly coupled, and a pivot cradle 19, which is adjustable in terms of its angular position in relation to the axis of the drive shaft. In the cylinder drum 15, a multiplicity of displacement pistons 20, which delimit in each case one working chamber 21, are guided parallel to the axis of the drive shaft. The supply of pressure medium to and the discharge of pressure medium out of the working chambers 21 is controlled by way of two kidney-shaped control ports 22 and 23, said kidney-shaped control ports being formed in a control plate 24 which is held rotationally fixedly with respect to the housing and having a pressure medium connection to a pressure port and a suction port in the port plate 13. The kidney-shaped control ports 22 and 23 themselves are not visible in the section in FIG. 1, because they are situated in front of and behind the plane of the drawing, but they are indicated for clarity.

The heads, facing away from the working chambers 21, of the displacement pistons 20 are supported by way of slide shoes 25 on a pivot cradle 19, the pivot angle $\alpha$ of which is, for the purposes of varying the swept volume, adjustable by way of an adjustment device 30 indicated by dash-dotted lines. In the exemplary embodiment illustrated, the pivot cradle 19 is preloaded by way of a restoring spring 31 into a basic position in which the pivot angle and thus the swept volume are at a maximum. By deployment of an adjustment piston 32, discussed in more detail below, of the adjustment device 30, the pivot cradle can be pivoted back counter to the force of the restoring spring and counter to the drive unit forces for a reduction of the pivot angle and thus of the swept volume, as far as into a position of minimum swept volume, for example as far as a swept volume of zero. FIG. 1 shows the pivot cradle in a position in which the abutment surface for the displacement pistons is perpendicular to the axis of the drive shaft, that is to say the swept volume is zero. By contrast, the displacement pistons are shown in a position of maximum swept volume. The connection of the adjustment device 30 to the pivot cradle 19 is realized, as illustrated, for example by way of a ball 33 which is inserted movably into the pivot cradle and which has a flattened portion.

Figure 2A:
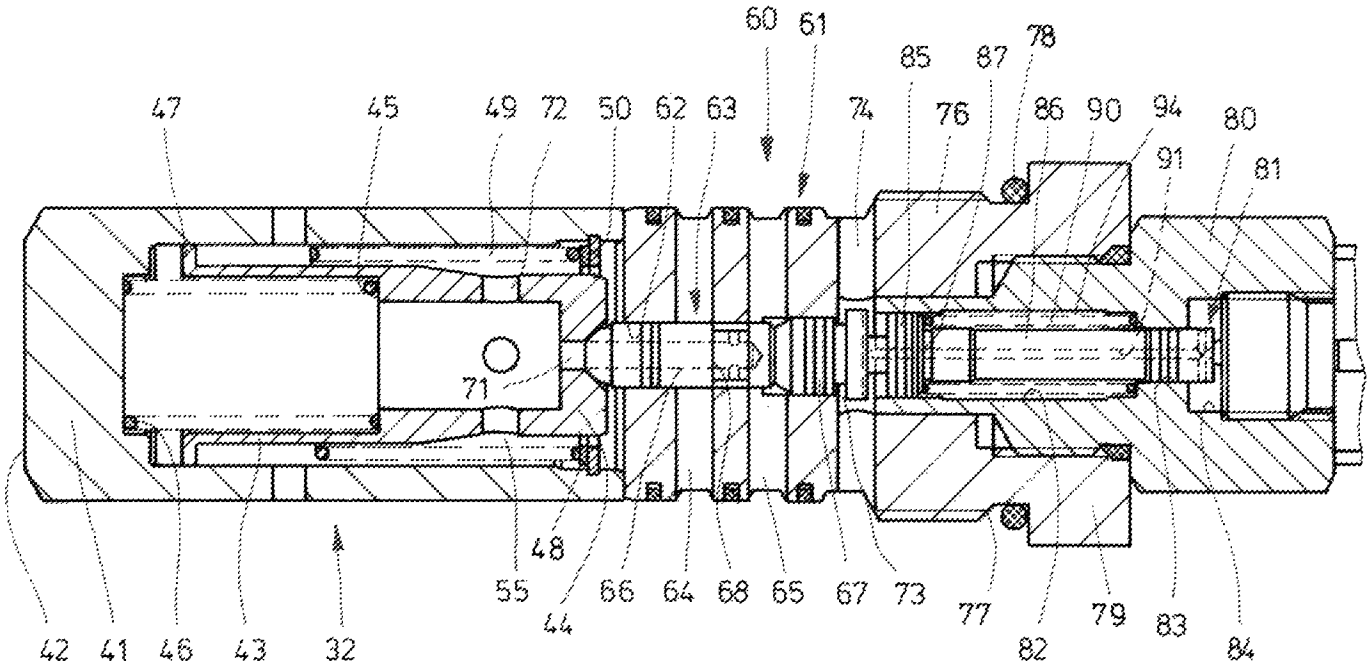
FIG. 2*a* shows a longitudinal section through a part of a first exemplary embodiment of an adjustment device according to the disclosure.
Figure 2B:
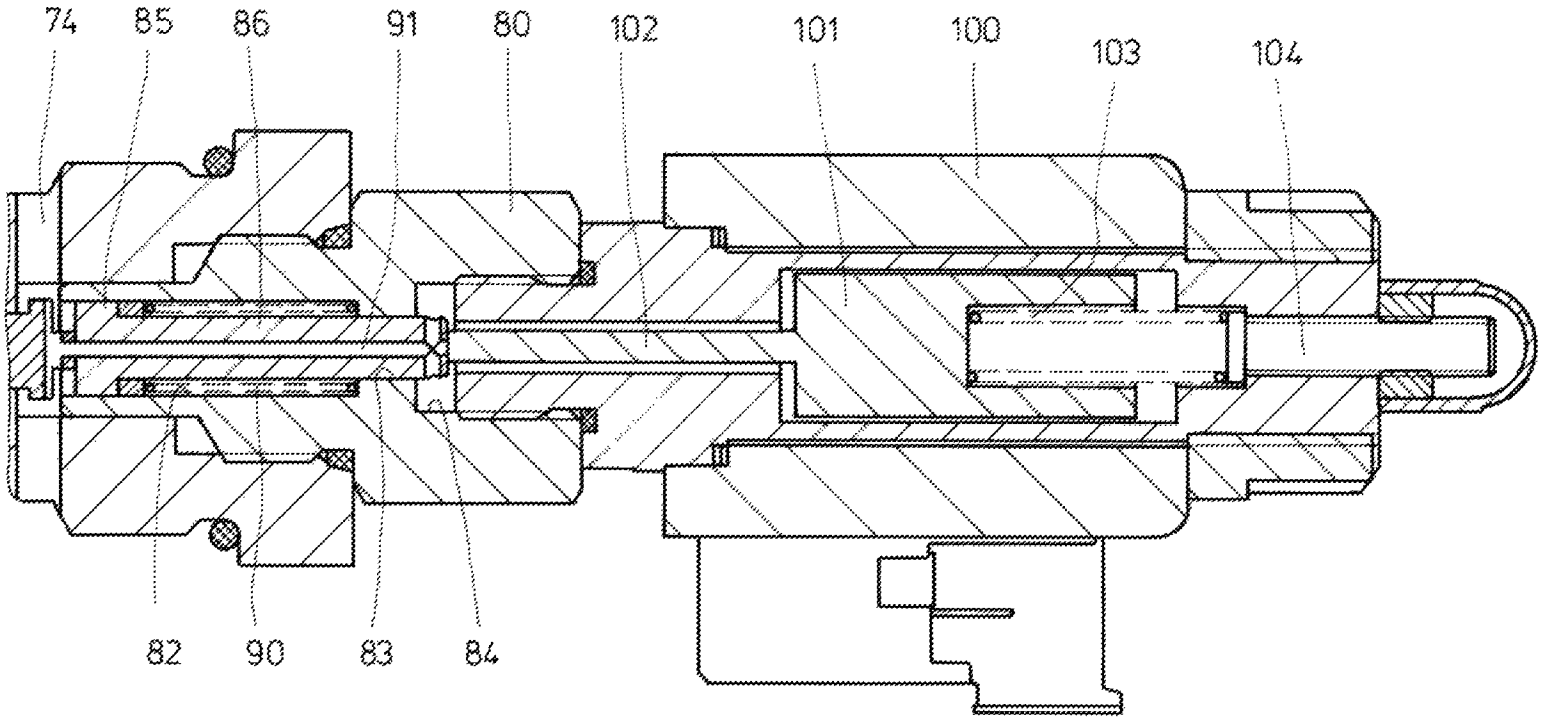
FIG. 2*b* shows a longitudinal section through another part of the first exemplary embodiment of an adjustment device according to the disclosure.
Figure 3:
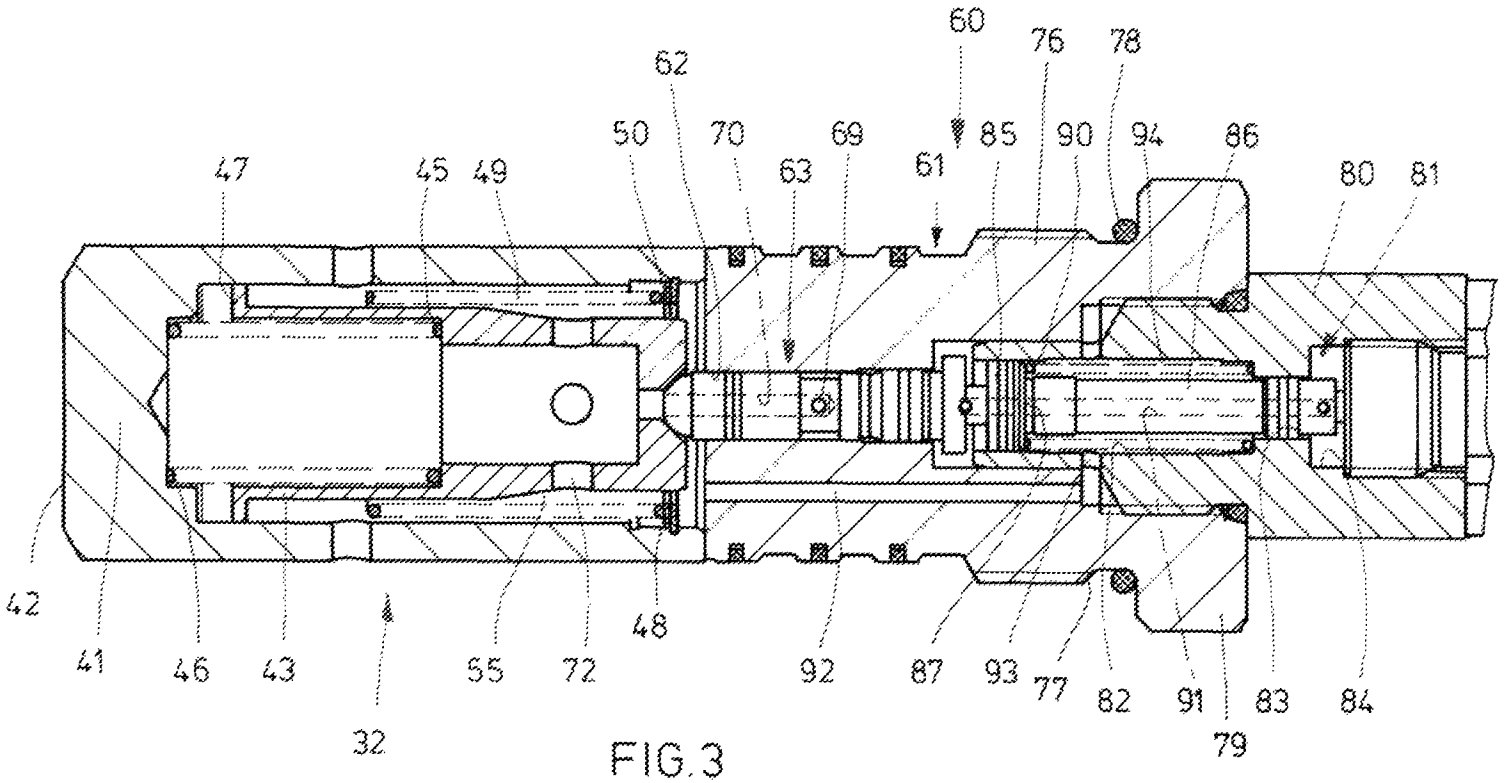
FIG. 3 shows a longitudinal section through the first exemplary embodiment of an adjustment device according to the disclosure in a plane rotated through 90 degrees in relation to the section plane in FIG. 2.
Figure 4:
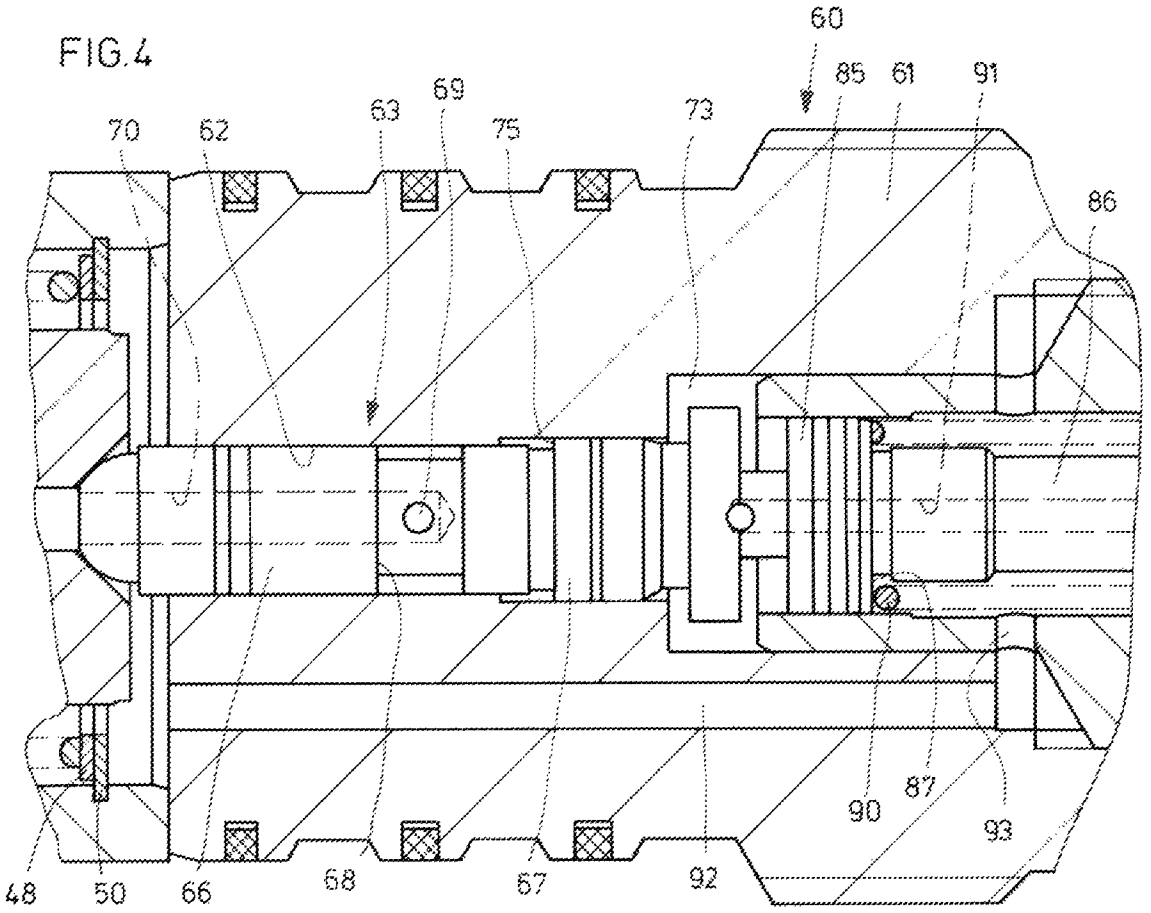
FIG. 4 is an enlarged illustration of a detail from FIG. 3.

A first adjustment device 30, which can be used for the axial piston pump from FIG. 1, is shown in FIGS. 2 to 4.

As main structural assemblies, the adjustment device 30 comprises the abovementioned adjustment piston 32 and a regulation valve 60, which are arranged in alignment one behind the other on the same central axis and are inserted into an elongate cavity of the housing main part 12. The regulation valve has a cartridge-like valve housing 61 which is screwed into the housing main part 12 and which has a valve bore 62, which valve bore runs in the direction of the central axis and in which valve bore a valve slide 63 is displaceable in the direction of the bore axis.

The adjustment piston 32 is guided in the housing main part 12 and is in the form of a bushing which is open toward the regulation valve 60 and which has a base 41 with a planar outer side 42, by way of which said adjustment piston bears against the flattened portion of the ball 33. In the interior of the adjustment piston 32 there is accommodated a bushing-like spring bearing 43 which is open toward the base 41 of the adjustment piston 32 and, by way of a base 44, faces toward the regulation valve 60, and bears by way of said base against the valve slide 63 of the regulation valve. A first feedback spring 46 in the form of a helical compression spring is braced between the base 41 of the adjustment piston 32 and an inner shoulder 45 which is situated approximately in the center of the spring bearing 43. The position of the inner shoulder 45 is dependent on the power level and the nominal size of a pump, and in other embodiments may be in a position other than that shown. The force exerted by the feedback spring 46 is always greater than zero, regardless of the position of the adjustment piston 32. At its open end, the spring bearing has an outer collar 47. This permits the abutment of a second feedback spring 49, which is in the form of a helical compression spring, against the spring bearing 43. The second feedback spring 49 is situated on the outside of the spring bearing 43, between the latter and the adjustment piston 32. Axially, said second feedback spring is arranged between the outer collar 47 on the spring bearing 43 and a circlip 50 which is inserted into the adjustment piston 32. Between the circlip and the feedback spring 49 there may be inserted one or more shims 48, or no shims, which serve for defining at what position of the adjustment piston 32 and thus of the pivot cradle 19 the second feedback spring 49 engages, and the bend in the characteristic curve is situated. Owing to the position of the inner shoulder 45 and of the outer collar 47 on the spring bearing 43, the two feedback springs 46 and 49 axially overlap, thus making it possible to realize a short construction.

By way of the outer collar 47, the spring bearing 43 is guided on the adjustment piston 32, thus giving rise to 2-point guidance for the spring bearing, with the outer collar 47 on the adjustment piston 32 and with the base 44 on the valve slide 63.

FIGS. 2 to 4 show the adjustment piston 32 in a position in which it bears against the valve housing 61 and which corresponds to a maximum swept volume of the axial piston pump. In this position of the adjustment piston 32, the clear spacing between the circlip 50 and the outer shoulder 47 is, taking into consideration the thickness of any shims 48 that may be provided, greater than the length of the fully relaxed second feedback spring 49. If, proceeding from the position shown in FIGS. 2 to 4, the adjustment piston 32 now moves away from the valve housing 61 in the direction of a smaller swept volume, initially only the feedback spring 46 is active, and the force exerted on the spring bearing 43 in the direction of the valve slide 63 decreases with travel, with a gradient corresponding to the spring constant of the feedback spring 46. Finally, the adjustment piston 32 reaches a particular position, in which the clear spacing between the circlip 50 and the outer shoulder 47 is, taking into consideration the thickness of any shims 48 that may be provided, equal to the length of the fully relaxed second feedback spring 49. During the further movement, the feedback spring 49 is then braced to an ever greater extent. Since the latter feedback spring exerts on the spring bearing 43 a force which is directed counter to the force of the feedback spring 49, it is the case that, proceeding from the particular position of the adjustment piston 32, the force exerted on the spring bearing 43 in the direction of the valve slide 43 decreases more rapidly with the travel of the adjustment piston 32 than before the particular position was overshot.

The valve bore 62 of the valve housing 61 is open toward the adjustment piston 32 and is transversely intersected, at positions axially spaced apart from one another, by a first transverse bore 64 and by a second transverse bore 65, which open out on the outside of the valve housing into annular chambers which are separated from one another and from the interior of the pump housing 11 by way of seals. The transverse bore 64 which is situated closest to that end of the valve housing 61 which faces toward the adjustment piston 32 is connectable directly, or via further regulators of the pump, to a tank. Said transverse bore thus serves as a pressure medium outflow duct. If the further regulators are active, the transverse bore 64 is connectable by way of the further regulators also to the pressure port of the pump, and then serves as a pressure medium inflow duct. The transverse bore 65 is connected to the pressure port of the pump. The latter transverse bore thus serves only as a pressure medium inflow duct.

The valve slide 63 has, between two control collars 66 and 67, an annular groove 68, the width of which is equal to the clear spacing between the two transverse bores 64 and 65. In the annular groove 68, the valve slide has, as a transverse bore, a radial bore 69 which, at the inside, intersects an axial bore 70 which is in the form of a blind bore and which is open at that face side of the valve slide 63 which faces toward the spring bearing 43 and the adjustment piston 32. The radial bore 69 has a smaller cross section than the axial bore 70. In this way, the reaction on the valve slide 63 is reduced, and thus the influence of the flow forces on the valve characteristic is reduced.

In the regulation position of the valve slide 63 shown in FIGS. 2 to 4, the two transverse bores 64 and 65 are just overlapped by the control collars 66 and 67. The regulation valve 60 is thus configured with a zero overlap. However, a slight negative overlap is also possible, wherein, then, the width of the annular groove 68 is slightly larger than the clear spacing between the two transverse bores 64 and 65. If, proceeding from the regulation position shown, the valve slide is moved to the left in the view as per FIGS. 2 to 4, a fluidic connection between the transverse bore 64 and an adjustment chamber 55 formed by the adjustment piston 32, the housing main part 12 and the valve housing 61 is produced via the annular groove 68 and the bores 69 and 70. Control oil can thus be displaced out of said adjustment chamber to the tank, such that the adjustment piston 32 moves, with a reduction in size of the volume of the adjustment chamber 55, in the direction of a larger swept volume.

If, proceeding from the regulation position shown, the valve slide is moved to the right in the view as per FIGS. 2 to 4, a fluidic connection between the transverse bore 65 and the adjustment chamber 55 is produced via the annular groove 68 and the bores 69 and 70. Control oil can then flow from the pressure port of the pump to said adjustment chamber, such that the adjustment piston 32 moves, with an increase in volume of the adjustment chamber 55, in the direction of a smaller swept volume. In order that the control oil can flow freely, the spring bearing is provided with a bore 71 in its base directly in front of the valve slide 63 and with openings 72 in its wall.

In the region of the transverse bore 65, the valve bore 62 has a step such that its diameter proceeding from the step to that end of the valve housing 61 which faces toward the adjustment piston 32 is slightly smaller than the diameter proceeding from the step in the other direction. Correspondingly to the step in the valve bore 62, the valve slide 63 has, in the control collar 67, a step in which the diameter increases from the diameter in the control collar 66 to a different diameter, such that a measurement surface 75 is formed at which the valve slide 63 is acted on by the pump pressure prevailing in the transverse bore 65. Said pump pressure generates, at the measurement surface 75, a pressure force which is oriented in the same direction as the force which is exerted on the valve slide 63 by the feedback springs 46 and 49 via the spring bearing 43.

At the other side of the transverse bore 65 as viewed from the transverse bore 64, the valve slide 63 protrudes into a widened section 73 of the valve bore 62, said widened section being connected by way of a transverse bore 74 to the interior of the pump housing. The housing pressure thus prevails in that region, which housing pressure is subject to only slight pressure fluctuations and corresponds approximately to the tank pressure. The force exerted on the valve slide 63 by said pressure is thus negligible.

Adjacent to the transverse bore 74, the valve housing 61 has a threaded section 76 which is provided, on the outside, with a thread and which is followed, after a turned recess 77 for a seal 78, by a flange 79. By way of the threaded section 76, the regulation valve 60 is screwed into the housing main part 12 until the flange 79 bears against the housing main part 12.

From the end facing away from the adjustment piston 32, there is screwed into the valve housing 61 a nipple-like auxiliary housing part 80 which, centrally, has a continuous cavity 81 with three cavity sections 82, 83 and 84 of different diameter. The middle cavity section 83 has the smallest diameter. The cavity section 82 which is adjacent in the inward direction toward the valve slide 63 has a larger diameter, wherein the diameter difference between the two stated cavity sections 82 and 83 is selected such that the difference in cross-sectional area between the two cavity sections corresponds exactly to the cross-sectional area of the valve slide 63 in the region of the control collar 66. It is by way of said cross-sectional area that the valve slide is forced to the right in the view of FIGS. 2 to 4 by the pressure prevailing in the adjustment chamber 55.

In the cavity section 82 of the auxiliary housing part 80 there is guided a compensation piston 85 which, by way of a piston rod 86, is guided with little play and in substantially sealed fashion through the cavity section 83 of the cavity 81 and projects into the cavity section 84 with the largest diameter. Owing to the piston rod 86, there is formed on the compensation piston 85, within the cavity section 82, an effective annular surface 87 which is equal to the cross-sectional area of the valve slide 63 in the region of the control collar 66. Via a longitudinal bore 91 and a transverse bore in the compensation piston 85, a transverse bore and a blind bore at that end of the valve slide 63 which faces toward the compensation piston, and the transverse bore 74 of the valve housing 61, the cavity section 84 is fluidically connected to the interior of the pump housing 11, in which approximately tank pressure prevails, such that the compensation piston 85 is relieved of pressure with regard to the guide cross section of its piston rod 86 in the cavity section 83.

The cavity section 82 of the cavity 81 accommodates not only the compensation piston 85 but also a regulation spring 90 which surrounds the piston rod 86 and is supported on a step between the two cavity sections 82 and 83 on the auxiliary housing part 80 and on the annular surface 87 of the compensation piston 85, and which forces the compensation piston 85 against the valve slide 63. The regulation spring 90 thus exerts, via the compensation piston 85, a force which is directed counter to the force generated by the pump pressure and counter to the force exerted by the feedback springs 46 and 49.

The volume, delimited by the compensation piston 85 and the auxiliary housing part 80, of the cavity section 82 is fluidically connected via an eccentrically situated longitudinal bore 92 in the valve housing 61 and via a transverse bore 93 in the auxiliary housing part 80 to the adjustment chamber 55 and thus forms a pressure chamber 94 in which the adjustment pressure prevails. The adjustment pressure acts on the compensation piston 85 at the annular surface 87, which is of the same size as the cross-sectional area of the valve slide 63 in the region of the control collar 66. The valve slide is thus acted on by the adjustment pressure at one side, at its face side facing toward the adjustment piston 32, in one direction and at the other side, via the compensation piston 85, in the opposite direction. The surfaces acted on are of equal size, such that the valve slide is force-balanced with regard to the adjustment pressure, or, to use the conventional term, pressure-balanced.

The longitudinal bore 92 extends from that face side of the valve housing 61 which faces toward the adjustment piston 32, and opens out in a step of a stepped recess of the valve housing 61 for the auxiliary housing part 80. From there, the bore 93 in the auxiliary housing part produces the connection to the pressure chamber 94. There is thus no need for an oblique or radial bore in the valve housing.

In the exemplary embodiment shown, the compensation piston 85 is, together with its piston rod 86, a stand-alone, unipartite component. The valve slide and the compensation piston may also be realized as a unipartite component. However, two separate parts make the manufacturing process easier, because alignment errors between the valve bore 62 in the valve housing 61 and the cavity section 82 in the auxiliary housing part 80 have no influence on the free movement of the valve slide 63 and of the compensation piston 85.

The cavity section 84 is equipped with an internal thread. Said cavity section can be closed off to the outside by way of a closure screw.

In the present case, however, a proportional electromagnet 100 is screwed onto the auxiliary housing part 80. The electromagnet has a magnet armature 101 with a plunger 102 which bears against the compensation piston 85, and a helical compression spring 103, which forces the magnet armature in the direction of the compensation piston 85. The helical compression spring 103 thus acts in addition to the regulation spring 90, and in the same direction as the latter, on the valve slide 63. The two springs 90 and 103 can be referred to collectively as regulation spring arrangement, said springs exerting on the valve slide a force in a direction which is directed counter to the force of the feedback springs 46 and 49 and counter to the pressure force generated by the operating pressure at the measurement surface 75 of the valve slide. The stress of the helical compression spring 103 can be varied by way of an adjustment screw 104. The adjustment screw is accessible even in the installed state of the regulation valve 60 in the pump. This permits simple tuning of the regulation valve to the pump. The adjustment of the torque is thus even possible in the field without dismounting the pump or the regulator. The two springs 90 and 103 may also be replaced with a single spring, which is then preferably arranged where the spring 103 is situated in the exemplary embodiment shown.

When the electromagnet 100 is energized, there is exerted on the magnet armature a force which is directed counter to the force of the helical compression spring 103. The force exerted by the electromagnet, including the helical compression spring 103, on the compensation piston 85 and thus on the valve slide can thus be varied during operation by varying the energization of the proportional magnet. In this way, the torque characteristic curve can be shifted. When the proportional magnet is deenergized, the regulated torque is at its greatest, because the electromagnet does not detract from the force of the helical compression spring. The proportional magnet has a falling characteristic curve because, with increasing current intensity, the force exerted via the plunger 102 on the compensation piston 85, and via the latter on the valve slide 63, decreases.

The use of a proportional electromagnet with a rising characteristic curve is also conceivable if the torque characteristic curve is to be shifted toward higher values with increasing current flowing through the electromagnet.

Since the housing pressure prevails in the cavity section 84 of the auxiliary housing part 80 and thus also in the proportional magnet 100, the proportional magnet does not need to be resistant to high pressure.

Instead of an electromagnet, it is also possible for there to be connected to the auxiliary housing part 80 a hydraulic control line via which the cavity section 84 can be connected to a control pressure source. Then, use is made of a compensation piston 85 without a longitudinal bore, such that the cavity section 84 is fluidically separated from the interior of the pump housing 11. A control pressure input into the cavity section 84 acts on the piston rod 86 of the compensation piston 85, such that, depending on the magnitude of the control pressure in addition to the force of the regulation spring 90, a different level of additional force acts on the valve slide 63, and the torque characteristic curve can be shifted.

The auxiliary housing part 80 is thus a universal interface for differently modified adjustment devices according to the disclosure.

FIGS. 2 to 4 show the adjustment device in a state in which the pivot cradle 19 of the axial piston pump from FIG. 1 has been pivoted to a maximum extent, and thus the swept volume is at a maximum. The first feedback spring 46 is braced to a maximum extent, and the second feedback spring 49 is inactive. The sum of the force of the feedback spring 46 and of the pressure force generated by the operating pressure at the measurement surface 75 of the valve slide 63 is lower than the force of the regulation spring 90. The variant of the adjustment device here is one in which the auxiliary housing part 80 is closed off by way of a closure screw and, aside from the force of the regulation spring, no additional force acts on the valve slide 63. The valve slide 63 is situated in a position in which it connects the adjustment chamber 55 to the transverse bore 64 and thus to the tank. However, the figures show the valve slide in the regulation position, in which it closes off the transverse bores 64 and 65 with slight positive or negative overlap.

The operating pressure may now rise to such an extent that the pressure force generated by the operating pressure at the measurement surface 75 plus the force of the feedback spring 46 becomes greater than the force of the regulation spring 90. The valve slide 63 is then displaced so as to connect the transverse bore 65 to the adjustment chamber 55, such that pressure medium flows into the adjustment chamber and the adjustment piston 32 moves away from the valve housing 61, while the spring bearing 43 remains in contact with the valve slide 63. As a result, the force of the feedback spring 46 becomes lower. When the sum of the lower force of the feedback spring 46 and the greater pressure force assumes a value equal to the force of the regulation spring 90, the valve slide 63 moves into its regulation position, in which it separates the adjustment chamber 55 from the transverse bores 64 and 65, aside from small regulation movements. A further increase in operating pressure leads again to a displacement of the valve slide, such that further pressure medium flows into the adjustment chamber 55 and the adjustment piston 32 moves further away from the valve housing 61, with a reduction in the force of the feedback spring 46, into a position in which the forces acting on the valve slide 63 are in equilibrium. If the operating pressure becomes lower, the valve slide is displaced out of the regulation position in the opposite direction, and connects the adjustment chamber 55 to the transverse bore 64, such that pressure medium flows out of the adjustment chamber. The adjustment piston 32 moves toward the valve housing, and the force of the feedback spring 46 increases until the decrease in pressure force is compensated.

The gradient of a curve representing the dependency between the travel of the adjustment piston 32 and the operating pressure is initially defined exclusively by the spring constant of the feedback spring 46.

During the further movement away from the valve housing 61, the adjustment piston 32 finally passes into a position in which the spacing between the outer collar 47 on the spring bearing 43 and the circlip 50 (including shims) corresponds to the length of the relaxed feedback spring 49. During the further movement of the adjustment piston 32, the feedback spring 49 then also becomes active. Then, the force exerted on the valve slide 63 via the spring bearing 43 decreases to a greater extent over a particular travel than before the feedback spring 49 became active, because not only does the force exerted on the spring bearing by the feedback spring 46 become lower, but the force of the feedback spring 49 acting in the opposite direction becomes greater. Correspondingly, the characteristic curve between the travel of the adjustment piston 32 and the operating pressure becomes steeper. Said characteristic curve is thus made up of two straight sections of different gradient, which intersect at a position of the adjustment piston 32 in which the feedback spring 49 becomes active and inactive.

If universality of the auxiliary housing part 80 and a displacement of the torque characteristic curve are not desired, then the cavity 81 does not need to be continuous, and instead may be a blind bore with two different diameters, wherein the chamber between the free face side of the piston rod and the base of the blind bore is fluidically connected to the transverse bore 74.

In many cases, torque regulation of a pump is combined with pressure regulation or with delivery flow regulation or with both further regulation types, and a regulation valve for the pressure regulation and a regulation valve for the delivery flow regulation are provided in addition to a regulation valve for the torque regulation. In the case of pressure regulation or delivery flow regulation, the pressure medium inflow and the pressure medium outflow into and out of the adjustment chamber 55 take place via the transverse bore 64 and the valve slide 63, which has been displaced out of the regulation position in the direction of the adjustment chamber 55. In order that, in particular, a pressure medium inflow, controlled by the delivery flow regulation valve, into the adjustment chamber 55 is possible even in the regulation position of the torque regulation valve 60, and the torque regulation is rapidly replaced by the delivery flow regulation, the valve slide 63 may have a bevel in the region of the control collar 66.

Figure 5:
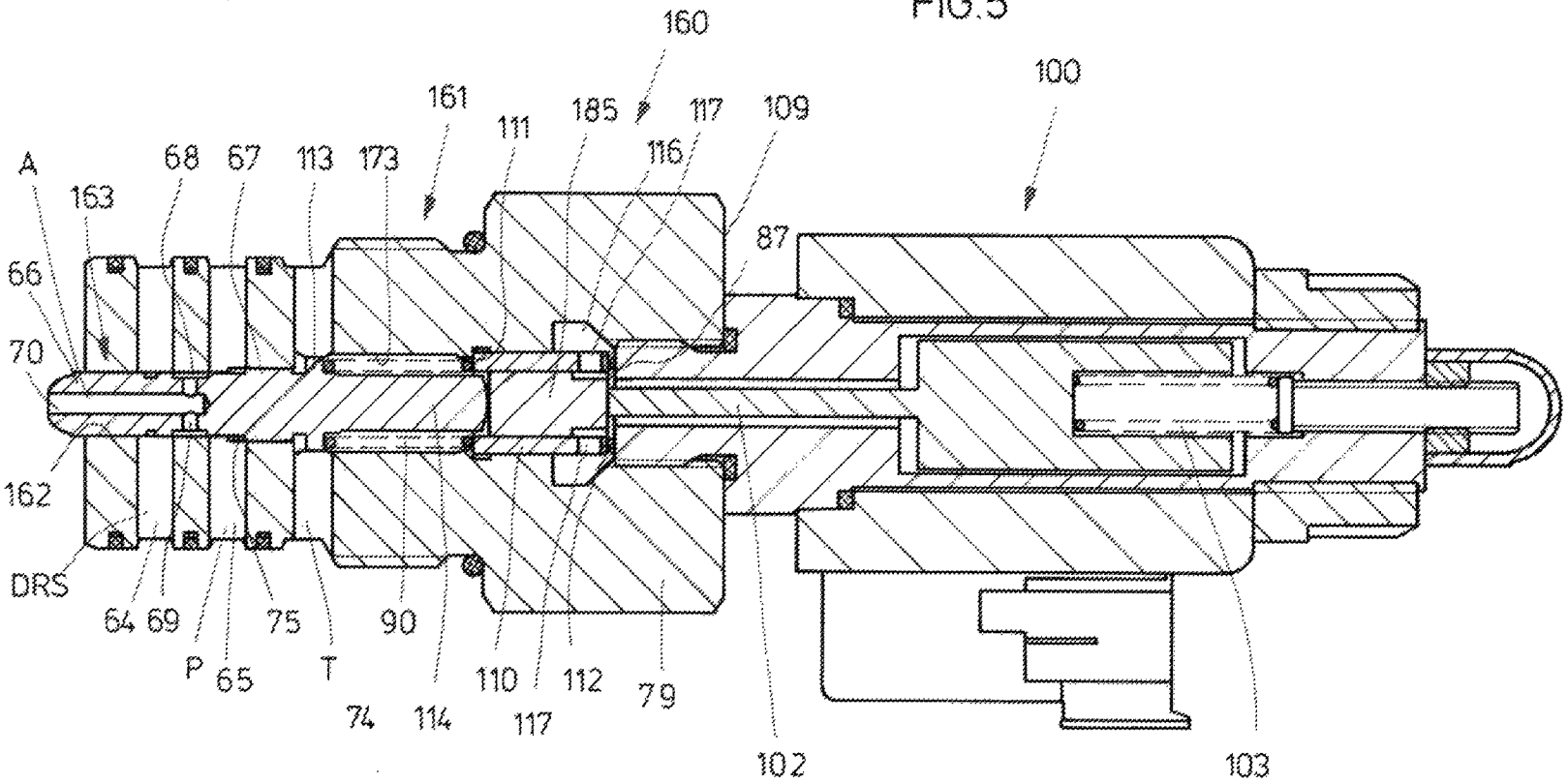
FIG. 5 shows a longitudinal section through the regulation valve of a second exemplary embodiment of an adjustment device according to the disclosure.
Figure 6:
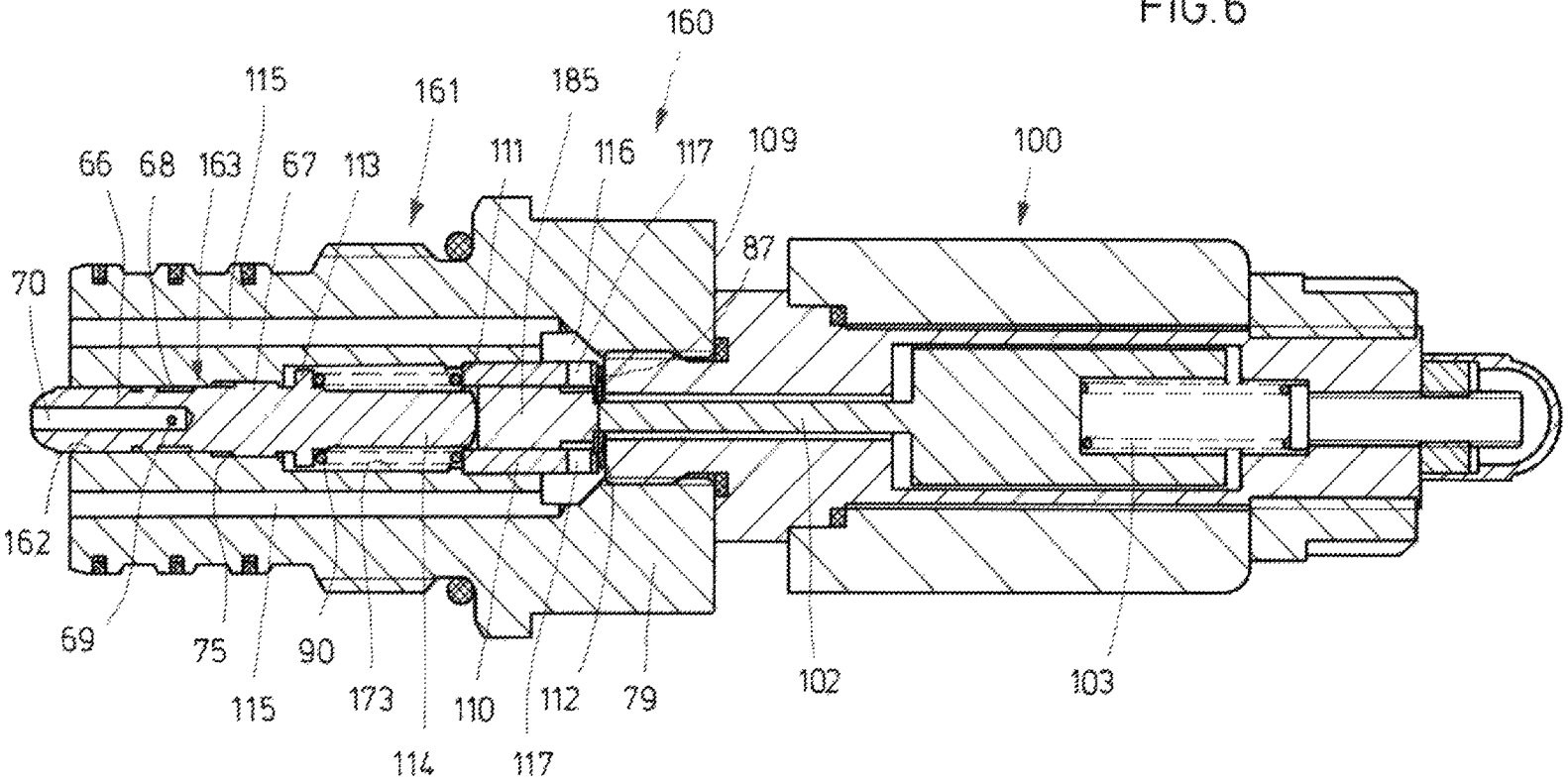
FIG. 6 shows a longitudinal section through the regulation valve from FIG. 5 in a plane rotated through 90 degrees in relation to the section plane in FIG. 5.

The regulation valve 160 as per FIGS. 5 and 6 forms, together with an adjustment piston as shown in FIGS. 2*a* and 3, a second exemplary embodiment, which is modified slightly in relation to the first exemplary embodiment, of an adjustment device according to the disclosure for a hydrostatic axial piston pump. Like the regulation valve 60 of the first exemplary embodiment, the regulation valve 160 has a cartridge-like valve housing 161 which can be screwed into the housing main part 12 of the axial piston pump as per FIG. 1 and which has a valve bore 162 which runs in its central axis and in which a valve slide 163 is longitudinally displaceable.

As in the first exemplary embodiment, the valve bore 162 of the valve housing 161 is open toward the adjustment piston 32 and is transversely intersected, at positions axially spaced apart from one another, by a first transverse bore 64 and by a second transverse bore 65, which open out on the outside of the valve housing into annular chambers which are separated from one another and from the interior of the pump housing 11 by way of seals. The transverse bore 64 which is situated closest to that end of the valve housing 161 which faces toward the adjustment piston 32 is connectable directly, or via further regulators of the pump, to a tank. Said transverse bore thus serves as a pressure medium outflow duct. If the further regulators are active, the transverse bore 64 is connectable by way of the further regulators also to the pressure port of the pump, and then serves as a pressure medium inflow duct. The transverse bore 65 is connected to the pressure port of the pump. The latter transverse bore thus serves only as a pressure medium inflow duct.

Like the valve slide 63, the valve slide 163 has, between two control collars 66 and 67, an annular groove 68, the width of which is equal to the clear spacing between the two transverse bores 64 and 65. In the annular groove 68, the valve slide 163 also has, as a transverse bore, a radial bore 69 which, at the inside, intersects an axial bore 70 which is in the form of a blind bore and which is open at that face side of the valve slide 163 which faces toward the spring bearing 43 and the adjustment piston 32. The radial bore 69 has a smaller cross section than the axial bore 70. In this way, the reaction on the valve slide 63 is reduced, and thus the influence of the flow forces on the valve characteristic is reduced.

In the regulation position of the valve slide 163 shown in FIGS. 5 and 6, the two transverse bores 64 and 65 are just overlapped by the control collars 66 and 67. The regulation valve 160 is thus, like the regulation valve 60, configured with a zero overlap. However, a slight negative overlap is also possible, wherein, then, the width of the annular groove 68 is slightly larger than the clear spacing between the two transverse bores 64 and 65. If, proceeding from the regulation position shown, the valve slide is moved to the left in the view as per FIGS. 5 and 6, a fluidic connection between the transverse bore 64 and an adjustment chamber 55 formed by the adjustment piston 32, the housing main part 12 and the valve housing 161 is produced via the annular groove 68 and the bores 69 and 70. Control oil can thus be displaced out of said adjustment chamber to the tank, such that the adjustment piston 32 moves, with a reduction in size of the volume of the adjustment chamber 55, in the direction of a larger swept volume.

If, proceeding from the regulation position shown, the valve slide 163 is moved to the right in the view as per FIGS. 5 and 6, a fluidic connection between the transverse bore 65 and the adjustment chamber 55 is produced via the annular groove 68 and the bores 69 and 70. Control oil can then flow from the pressure port of the pump to said adjustment chamber, such that the adjustment piston 32 moves, with an increase in volume of the adjustment chamber 55, in the direction of a smaller swept volume.

In the region of the transverse bore 65, the valve bore 162 has a step such that its diameter proceeding from the step to that end of the valve housing 161 which faces toward the adjustment piston 32 is slightly smaller than the diameter proceeding from the step in the other direction. Correspondingly to the step in the valve bore 162, the valve slide 163 has, in the control collar 67, a step in which the diameter increases from the diameter in the control collar 66 to a different diameter, such that a measurement surface 75 is formed at which the valve slide 163 is acted on by the pump pressure prevailing in the transverse bore 65. Said pump pressure generates, at the measurement surface 75, a pressure force which is oriented in the same direction as the force which is exerted on the valve slide 63 by the feedback springs 46 and 49 via the spring bearing 43.

The valve housing 161 together with the valve bore 162 and the valve slide 163 of the regulation valve 160 as per FIGS. 5 and 6 differ from the valve housing 61 and the valve slide 63 of the regulation valve 60. Specifically, the valve housing 161 is longer, in the direction of its central axis, than the valve housing 61 because the flange 79 of said valve housing 161 is significantly longer than the flange 79 of the valve housing 61. On the length between the transverse bore 74 and the face side 109 of the flange 79, an opposing spring 90, a bushing 110 and a threaded stub of a proportional electromagnet 100 are accommodated in series in a widened section 173 of the valve bore 162. The valve housing 161 is thus not provided for an auxiliary housing part to be screwed in. The entire structural length of the valve from FIGS. 5 and 6 is therefore shorter than the structural length of the valve from FIG. 2.

The bushing 110 is pushed in, from the face side 109 of the flange 79, as far as a housing step 111 in the valve bore 162. There is a metallic seal between the outer side of the bushing 110 and the valve housing 161. The inner diameter of the bushing 110 is equal to the inner diameter of the valve bore 162 and to the outer diameter of the valve slide 163 in the region in which the valve bore opens out into the adjustment chamber. The bushing 110 is forced against the housing step 111, and thereby fixed in terms of its position with respect to the valve housing 161, by a plate spring 112 which is braced between the bushing 110 and the threaded stub of the electromagnet 100. The opposing spring 90 is braced between the bushing 110 and a collar 113 of the valve slide, which collar, in the regulation position of the valve slide 161, is situated in the region of the transverse bore 74. That region of the valve bore 162 in which the opposing spring 90 is situated is open toward the transverse bore 74 in all positions of the valve slide 163, such that housing pressure prevails in that region, which housing pressure is subject to only slight pressure fluctuations and corresponds approximately to the tank pressure. The force exerted on the valve slide 163 by said pressure is thus negligible.

The valve slide 163 is longer than the valve slide 63 of the regulation valve 60 from FIGS. 2 to 4, and extends by way of a projection 114, which is situated within the opposing spring 90, as far as the bushing 110, into which said projection protrudes slightly by way of a domed face side.

A compensation piston 185 is guided in the bushing 110 in longitudinally movable fashion and with little play, that is to say in substantially sealed fashion, which compensation piston is in the form of a simple plunger piston and, correspondingly to the inner diameter of the bushing 110, has an outer diameter which is equal to the outer diameter of the valve slide 163 in the region of the control collar 66. By virtue of the fact that the valve slide and compensation piston are two parts, alignment errors between those regions of the valve bore in which the valve slide is guided and the bushing 110 do not have an effect on the mobility of the valve slide. It is however basically conceivable for the valve slide and compensation piston to form a single part. At its first face side facing away from the valve slide, the compensation piston 185 is, like the compensation piston 85 of the exemplary embodiment as per FIGS. 2 to 4, acted on by a plunger 102, via which the helical compression spring 103 situated in the electromagnet 100 and the energized electromagnet exert a force on the compensation piston 185. Owing to the helical compression spring 103, the compensation piston 185 always bears by way of its other face side against the domed face side of the valve slide 163.

That region of the valve bore 162 in which that face side of the compensation piston 185 which faces away from the valve slide 163 is situated is fluidically connected to the adjustment chamber 55 and forms a pressure chamber in which the adjustment pressure prevails, such that the compensation piston is, at a compensation surface 87 which is of the same size as the surface of the valve slide 163 in the region of the control collar 66, acted on by the adjustment pressure and pushed with a corresponding force against the valve slide 163. The latter is thus pressure-balanced with regard to the adjustment pressure. Via the magnet bore in which the plunger 102 extends, the adjustment pressure also prevails in the electromagnet 100, such that the latter must be designed to be resistant to high pressure.

The fluidic connection from the adjustment chamber 55 to the pressure chamber in front of one face side of the compensation piston 185 is realized by way of two longitudinal bores 115 which proceed from that face side of the valve housing 161 which faces toward the adjustment chamber 55 and which extend parallel to the valve bore 162 in the valve housing, by way of an encircling groove 116, which intersects the longitudinal bores 115, of the valve bore in the region of the bushing 110, by way of bores 117 in the bushing 110, and by way of an annular gap which extends from the bores 117, between the bushing and the compensation piston 185, to one end of the bushing.

In terms of function, the regulation valve 160 corresponds entirely to the regulation valve 60 from FIGS. 2 to 4, such that, with regard to function, reference may be made to the relevant parts of the description.

Figure 7:
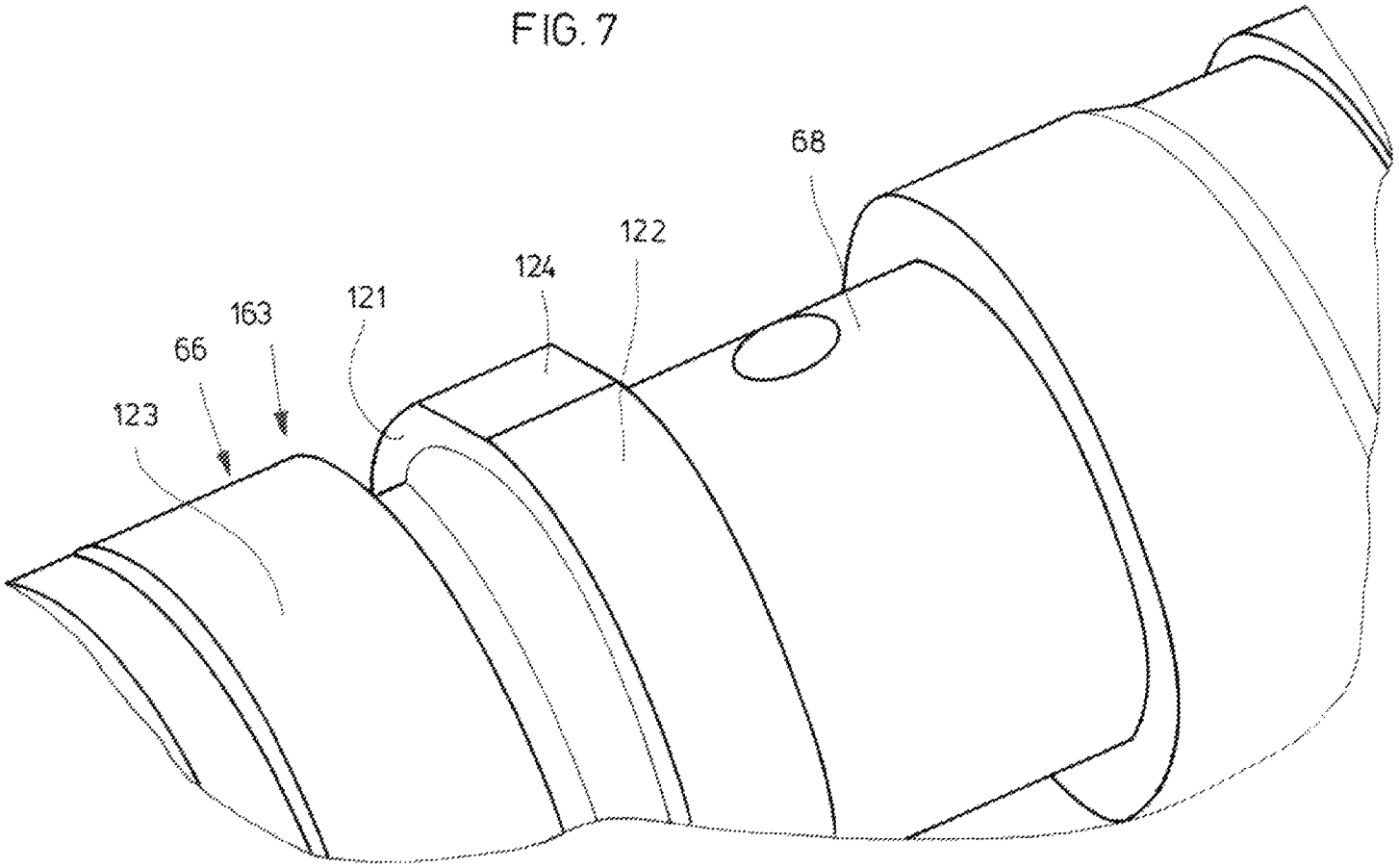
FIG. 7 shows a perspective view of a detail of the valve slide of the regulation valve from FIGS. 5 and 6.

As in the case of the valve slide 63, a bevel is also provided on the valve slide 163, which bevel ensures rapid replacement of the torque regulation by delivery flow regulation or pressure regulation. The bevel can be seen in FIG. 7. To form the bevel, the collar 66 of the valve slide 163 is divided, by way of an additional annular groove 121, into a narrow control collar 122 and a long guiding and sealing collar 123. Then, the control collar 122 is provided with in each case one flattened portion 124 at two mutually opposite points by removal of a cylindrical segment of small height. The annular groove 68 of the valve slide 163 is permanently connected to the transverse bore 64 by way of the two flattened portions 124. The two flattened portions 124 thus form the bevel.

LIST OF REFERENCE NUMERALS

11 Pump housing
12 Housing main part
13 Port plate
14 Drive unit
15 Cylinder drum
16 Drive shaft
17 Tapered-roller bearing
18 Tapered-roller bearing
19 Pivot cradle
20 Displacement piston
21 Working chamber
22 Kidney-shaped control port
23 Kidney-shaped control port
24 Control plate
25 Slide shoe
30 Adjustment device
31 Restoring spring
32 Adjustment piston
33 Ball
41 Base of 32
42 Outer side of 41
43 Spring bearing
44 Base of 43
45 Inner shoulder of 43
46 Feedback spring
47 Outer collar of 43
48 Shim
49 Feedback spring
50 Circlip
55 Adjustment chamber
60 Regulation valve
61 Valve housing
62 Valve bore
63 Valve slide
64 First transverse bore
65 Second transverse bore
66 Control collar on 63
67 Control collar on 63
68 Annular groove on 63
69 Radial bore in 63
70 Axial bore in 63
71 Bore in 43
72 Opening in 43
73 Section of 62
74 Transverse bore in 61
75 Measurement surface on 63
76 Threaded section of 61
77 Turned recess of 61
78 Seal
79 Flange of 61
80 Auxiliary housing part
81 Cavity
82 Cavity section
83 Cavity section
84 Cavity section
85 Compensation piston
86 Piston rod of 85
87 Annular surface on 85
90 Regulation spring
91 Longitudinal bore
92 Longitudinal bore
93 Transverse bore
94 Pressure chamber
100 Proportional electromagnet
101 Magnet armature
102 Plunger
103 Helical compression spring
104 Adjustment screw
109 Face side of 161
110 Bushing
111 Housing step in 162
112 Plate spring
113 Collar of 163
114 Projection of 163
115 Longitudinal bore in 161
116 Groove
117 Bore
121 Annular groove in 163
122 Control collar on 163
123 Sealing collar
124 Flattened portion
160 Regulation valve
161 Valve housing of 160
162 Valve bore of 160
163 Valve slide

What is claimed is:

1. An adjustment device for regulating a torque of a hydraulic piston machine with an adjustable swept volume, comprising:

an adjustment piston that defines an adjustment chamber;

a regulation valve that includes:

a valve housing that defines a valve bore; and a valve slide arranged in the valve bore, and configured to control inflow and outflow of a pressure medium to and from the adjustment chamber, the valve slide having a measurement surface configured and arranged to enable an operating pressure of the piston machine to act on the valve slide at the measurement surface in a first displacement direction;

wherein the valve bore is open towards the adjustment chamber such that a first face of the valve slide facing towards the adjustment chamber is acted on by an adjustment chamber pressure in the first displacement direction;

at least one feedback spring that exerts a feedback force on the valve slide in the first displacement direction, the feedback force being dependent on a position of the adjustment piston;

a regulation spring that exerts a further force on the valve slide in a second displacement direction opposite to the first displacement direction; and a compensation surface configured and arranged such that the compensation surface has an area as large as an area of the first face, and such that the compensation surface is permanently acted upon by the adjustment chamber pressure so as to generate a force acting on the valve slide in the second displacement direction.

2. The adjustment device according to claim 1, wherein the adjustment piston is configured to have a smallest spacing relative to the valve slide when the piston machine has a maximum swept volume, and to have a greatest spacing relative to the valve slide when the piston machine has a minimum swept volume.

3. The adjustment device according to claim 1, further comprising:

a component comprising a collar and a central projection, the collar including an annular surface that defines the compensation surface, wherein:

the central projection has a first diameter that is less than an outer diameter of the collar, the first diameter defining an inner diameter of the annular surface;

the annular surface defines a pressure chamber that is permanently fluidically connected to the adjustment chamber; and the central projection protrudes into a central recess of the adjustment device in a sealing fashion, the central recess being open towards the pressure chamber.

4. The adjustment device according to claim 3, wherein:

the component defines a bore arrangement configured such that a volume located adjacent to a free end of the central projection is fluidically connected to a tank port of the regulation valve such that the volume is configured to be charged with a pressure that is equal to a tank pressure of the tank port.

5. The adjustment device according to claim 3, wherein the central projection is configured such that a first force acting on the central projection enables a combined force exceeding the further force of the regulation spring to be exerted on the valve slide in the second displacement direction.

6. The adjustment device according to claim 5, wherein the volume adjacent to the free end of the central projection is configured to be charged via a hydraulic or pneumatic control pressure.

7. The adjustment device according to claim 3, wherein the regulation spring is configured and arranged within the pressure chamber surrounding the central projection of the component, and the regulation spring is supported by the annular surface of the collar.

8. The adjustment device according to claim 3, further comprising an auxiliary housing part that defines an elongation of the valve bore and is fastened to the valve housing, wherein the auxiliary housing part defines a cavity having a first cavity section that forms the central recess.

9. The adjustment device according to claim 8, wherein the cavity of the auxiliary housing part further has a second cavity section in which the collar of the component is received, the second cavity section forming the pressure chamber.

10. The adjustment device according to claim 1, further comprising:

an auxiliary housing part that is fastened to the valve housing, and that defines an elongation of the valve bore, the auxiliary housing part defining a cavity that has:

a first cavity section that is open towards the valve bore; and a second cavity section that adjoins the first cavity section in a direction away from the valve bore, and that has a second cavity section diameter which is smaller than a first cavity section diameter of the first cavity section; and a compensation piston, separate from the valve slide, that includes:

a piston rod part configured and arranged to guide the compensation piston in sealing fashion in the second cavity section; and an annular surface, wherein:

the second cavity section diameter that is equal to an inner diameter of the annular surface;

the annular surface has an area as large as an area of the first face of the valve slide; and the annular surface defines a pressure chamber that is fluidically connected to the adjustment chamber;

a portion of the compensation piston is configured to guide the compensation piston in a sealing fashion in either the first cavity section or the valve housing;

wherein, in a region of an end of the valve slide facing towards the compensation piston and adjacent to a face of the compensation piston facing towards the valve slide, the valve bore is fluidically connected to a tank port of the regulation valve.

11. The adjustment device according to claim 1, wherein:

the valve housing further defines valve ports;

the compensation surface is defined by a circular surface on a plunger piston component;

the plunger piston component is configured and arranged such that an outer circumference of the plunger piston component is guided in sealed fashion with respect to the valve ports and defines a guide length of the plunger piston component;

one side of the guide length, facing away from the adjustment piston, defines a pressure chamber that is fluidically connected to the adjustment chamber; and the valve bore, on another side of the guide length, is fluidically connected to a tank port of the regulation valve.

12. The adjustment device according to claim 11, further comprising an abutment that is fixed with respect to the valve housing, wherein:

the valve slide defines a collar; and the regulation spring is independent of the plunger piston component, and is braced against the collar of the valve slide and against the abutment.

13. The adjustment device according to claim 12, wherein:

the abutment is defined by a bushing inserted into the valve housing, the bushing being configured to guide the plunger piston component in a sealed fashion; and the regulation spring is braced between the collar of the valve slide and the bushing.

14. The adjustment device according to claim 11, further comprising:

a bushing inserted into the valve housing, the bushing configured to guide the plunger piston component in a sealed fashion; and a spring element braced between the bushing and (i) a component or (ii) structural assembly, mounted on the valve housing;

wherein:

the valve housing defines a step; and the spring element is configured and arranged to force the bushing against the step.

15. The adjustment device according to claim 3, wherein the component is a compensation piston that is separate from the valve slide.

16. The adjustment device according to claim 3, further comprising a mechanical component configured to exert a force that acts on the component.

17. The adjustment device according to claim 1, wherein:

the valve housing further defines a pressure medium inflow duct and a pressure medium outflow duct; and the valve slide defines an annular groove that is configured to form a fluidic connection between the adjustment chamber and the pressure medium inflow duct when the valve slide is displaced from a regulation position in the first displacement direction, and that is further configured to form a fluidic connection between the adjustment chamber and the pressure medium outflow duct when the valve slide is displaced from the regulation position in the second displacement direction.

18. The adjustment device according to claim 17, wherein the valve slide further defines:

a transverse bore that is located in the fluid connection between the annular groove and the adjustment chamber, and that opens out in the annular groove; and an axial bore that is located in the fluid connection between the annular groove and the adjustment chamber, and that opens out at the face of the valve slide.

19. The adjustment device according to claim 18, wherein the transverse bore has a cross section that is smaller than a cross section of the axial bore.

20. A hydrostatic axial piston machine, comprising:

an adjustment device that includes:

an adjustment piston that defines an adjustment chamber;

a regulation valve that has:

a valve housing that defines a valve bore; and a valve slide arranged in the valve bore, and configured to control inflow and outflow of pressure medium to and from the adjustment chamber, the valve slide having a measurement surface configured and arranged such that an operating pressure of the piston machine acts on the valve slide at the measurement surface in a first displacement direction, wherein the valve bore is open towards the adjustment chamber such that a face of the valve slide facing towards the adjustment chamber is acted on by an adjustment chamber pressure in the first displacement direction;

at least one feedback spring that exerts a feedback force on the valve slide in the first displacement direction, the feedback force being dependent on a position of the adjustment piston;

a regulation spring that exerts a further force on the valve slide in a second displacement direction opposite to the first displacement direction; and a compensation surface configured and arranged such that the compensation surface has an area as large as an area of the first face, and such that the compensation surface is permanently acted upon by the adjustment chamber pressure so as to generate a force acting on the valve slide in the second displacement direction.

* * * * *